US007784748B2

(12) United States Patent
Biddiscombe

(10) Patent No.: US 7,784,748 B2
(45) Date of Patent: Aug. 31, 2010

(54) SWING AWAY MAILBOX POST

(76) Inventor: David William Biddiscombe, 10 Oak La., Randolph, NJ (US) 07869

( * ) Notice: Subject to any disclaimer, the term of this patent is extended or adjusted under 35 U.S.C. 154(b) by 89 days.

(21) Appl. No.: 12/272,475

(22) Filed: Nov. 17, 2008

(65) Prior Publication Data

US 2009/0250509 A1 Oct. 8, 2009

Related U.S. Application Data

(60) Provisional application No. 61/041,703, filed on Apr. 2, 2008.

(51) Int. Cl.
*A47J 47/16* (2006.01)

(52) U.S. Cl. ..... 248/145; 248/289.31; 248/900

(58) Field of Classification Search ..... None
See application file for complete search history.

(56) References Cited

U.S. PATENT DOCUMENTS 3,407,997 A * 10/1968 Wood et al. ..... 232/39
3,802,656 A 4/1974 Virblas
3,870,262 A 3/1975 Manning
4,955,533 A 9/1990 Merkel
5,020,720 A 6/1991 Harpe
5,167,364 A 12/1992 Wenning
5,215,283 A 6/1993 Gould
5,307,598 A * 5/1994 West ..... 52/155
5,445,086 A 8/1995 Bolduc
5,458,286 A 10/1995 Paschal
5,699,989 A 12/1997 Guthrie
5,713,514 A 2/1998 Eck
5,779,202 A 7/1998 Black et al.
5,941,455 A 8/1999 Cutugno
6,047,933 A 4/2000 Hoover
6,164,527 A 12/2000 Garey
7,032,811 B1 4/2006 Paulic et al.
7,172,163 B1 2/2007 Johnson

* cited by examiner

*Primary Examiner*—Amy J Sterling
(74) *Attorney, Agent, or Firm*—Berenato & White, LLC

(57) ABSTRACT

The invention relates to a swing away mail box post which is simple to operate and manufacture. It includes two parts: a stationary base; and, a rotating stem (the latter of which is attached to the mailbox post itself). There is only one moving part, the stem rotates on the base as you desire. You just set the desired direction upon base installation by relying on a directed notch or keyway that interacts with a stem mounted screw to bias the location of the stem with respect to the base post. The installation of the base is straight forward, and the stem is adaptable to any standard type mailbox post, i.e., 3" round metal, 4"×4" wood, and 3½"×3 ½" P.V.C. sq. type post. This mailbox post system also includes two base configurations, one for stable packed soil, grass, etc. and one for sandy (i.e., loose) soil.

9 Claims, 3 Drawing Sheets

SWING AWAY MAILBOX POST

This application claims the benefit of prior filed U.S. Provisional Application Ser. No. 61/041,703, filed Apr. 2, 2008.

BACKGROUND OF THE INVENTION

1. Field of the Invention

The invention relates generally to a swing away mailbox post. Specifically the invention relates to a swing away mailbox post constructed of readily available pipe fittings and lengths that, when assembled in accord with the specification herewith, results in an inexpensive yet robust construction.

2. Background

As long as rural mail delivery has existed in snow bound areas, the concept of a "swing away" mailbox has existed. All such mailboxes share the common feature/function of moving out of harms' way when a snow plow or farm implement passes by and knocks the mailbox away from the traveled road. However, many of these existing mechanisms are overly complex, not sufficiently corrosion resistant and, when damaged, are difficult and costly to repair owing to the "custom" aspect of their construction with many specialized parts and features.

SUMMARY OF THE INVENTION

The present invention advantageously fills the aforementioned deficiencies of the prior art. First, this mailbox post provides safe and easy access to your mail. Many mailboxes in rural areas of the country are located where roads are narrow making retrieval of mail difficult and dangerous. The mailbox according to this invention can easily be swung to any direction for safe and easy access to your mail and then returned to the normal position, for the next delivery. Second, the post and mailbox can be removed easily if necessary, for example for lawn maintenance. Simply lift the post attached to the stem from the base. The third feature helps prevent snow plows or vandals from damaging the mailbox because it has the flexibility to swing out of harms' way.

The present invention, when compared to known swing away mailboxes, is the most functional and most easily produced swing away mail box post system. It can currently be produced for under ten U.S. dollars in terms of materials costs. My invention is compatible with all the most popular post types on the market today. Also, with two types of bases for the post, the swing away mailbox system herein is compatible with every soil consistency.

The present invention includes two basic parts. The first part is the base. There are two different types of bases: type A and type B. Type A is for packed soil or grass and comprises a length of galvanized pipe nipple, with a galvanized coupling on the top end. The galvanized coupling has a ¼" beveled cut, called a notch or keyway, which will face the road or any position you desire for the mailbox post to return to at "rest". Type B is designed for installation in sandy soil. It consists of a galvanized coupling with the same keyway as in type A, but the length galvanized nipple is 40" long. Both bases are encased in a 10" diameter×8" deep, 5000 lb. concrete (Sakrete or equivalent) surround. When finished the top should be at finished grade, so that when it is easily removed for lawn maintenance there is no conflict with the mower or other equipment that passes overhead.

The second basic part is the "Stem" which is attached to the actual mailbox post. There are several different stems for the different posts. The bottom sections are all the same. The bottom section is made from a complementary length of galvanized pipe nipple but with a smaller diameter (than the support post) galvanized couplings at each end. It has a metal plate at the top (immediately beneath the post above) with a self tapping pan head screw (a plated screw with two plated washers ) having the head downwardly oriented. The screw head sits in the base keyway in the normal primary position. The entire stem (top and bottom) mailbox post all swivel smoothly in the base, but will stop in the keyway until you wish to move it.

Finally, it is an object of the present invention to provide a swing away mail box post that does not suffer from any of the problems or deficiencies associated with prior solutions.

The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 10:
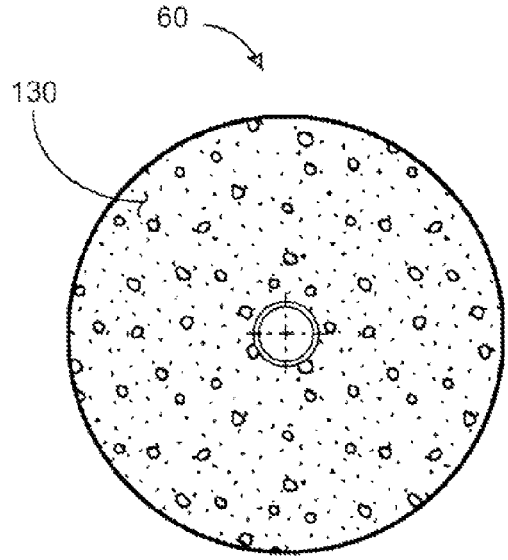
FIG. 10 is a top view of the beach installation
Figure 9:
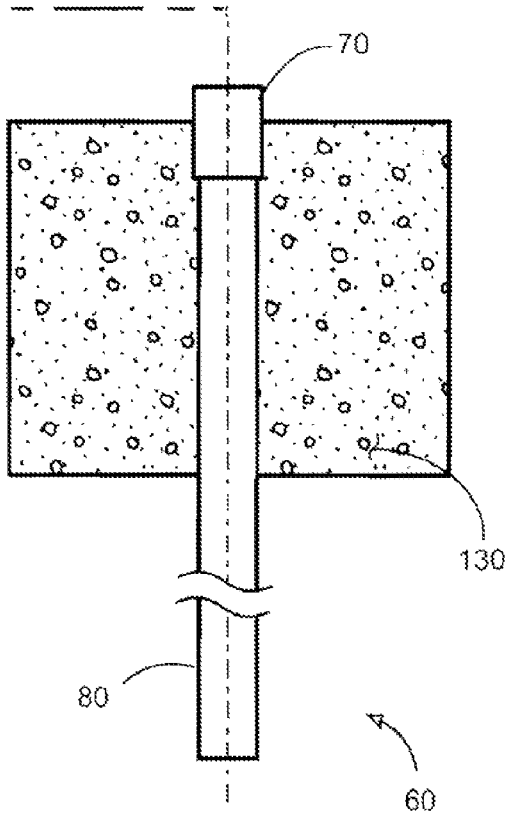
FIG. 9 is an elevation partially sectioned view of a base for a beach (loose soil) installation with optional concrete surround

With reference to the drawing FIGS. 1-4, 9 and 10: The present invention includes two basic parts. The first part is the base 10. There are two different types, type A and type B. Type A 20, FIGS. 1-4, is for packed soil or grass and base post combination 10 comprises 1"×5" galvanized pipe nipple 80, with a 1" galvanized coupling 70 on the top end. The 1" galvanized coupling has a ¼" beveled cut 120, called a keyway or notch, which will face the road or any position you desire for the mailbox post to be at "rest". Type B 60, FIGS. 9 and 10, is designed for installation in sandy soil. It includes a 1" galvanized coupling 70 with the same keyway as in type A, but the 1" galvanized nipple is 40" long. Both bases are encased in 10" diameter×8" deep, 5000 psi. concrete (Sakrete or equivalent) surround 130 that stabilizes the pipe length in the ground. When finished the top should be at finished grade, so that when the inserted stem is easily removed for lawn maintenance there is no conflict with the mower. In the case of the sandy soil installation the concrete may be optional depending on how tightly packed the surrounding soil is that is supporting the post.

The second part is the "Stem" which attaches to the post to which the actual mailbox attaches. With reference to drawing FIGS. 5-8: There are several different stems 30 (for a standard post), 40 (for a 3" round steel post), 50 (for a 4×4 treated post) for the different types of decorative posts selected. The bottom sections of the respective stems, that extend into the base engaged in the ground, are all the same. The bottom section is made from one ½"×5" galvanized pipe nipple 282 with a ½" galvanized coupling 271, 272 at each end. It has a metal plate 903 at the top with a ½×#10 self tapping pan head plated screw 180 with two #10 plated washers. The downwardly oriented screw head sits in the base keyway in the normal primary at rest position. The weight of the stem and post is transferred onto the upper surround of the base 10 coupling 70 via metal plate 903. The entire stem (top decorative post and bottom pipe nipple) all swivel smoothly in the base 10, but will stop in the keyway 120 in the rest or neutral position owing to the screw head 180 resting in the keyway 120 until you wish to move it. The plate mounted screw and washer combination rotates with the plate and rides up the edge of the notch 120 in the coupling 70 and urges the stem/post assembly slightly upwardly and creates slight resistance to rotation. When returned to the rest position, the screw and washer combination 180 rides down the edge of the notch 120 and is retained against completely free rotation against the respective sloped sides of the notch 120.

The present invention is compatible with several of the most popular manufactured posts on the market today, including the standard "3" round metal (shown in FIG. 6 with treated wood section 150 for attaching the metal post 290), 4"×4" wood 150 (including with U.S. Fence P.V.C. sleeve), and the 3½"×3½" P.V.C. sq. type post 190.

Installing the SwingAway Mailbox post system in accord with the present invention is quite straight forward; the system includes two base options and three adaptable stem pieces.

Figure 1:
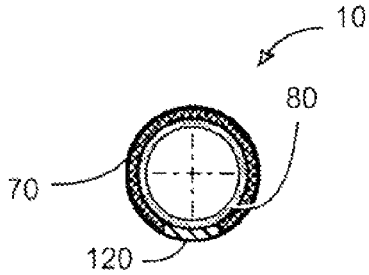
FIG. 1 is a top view of a standard base
Figure 3:
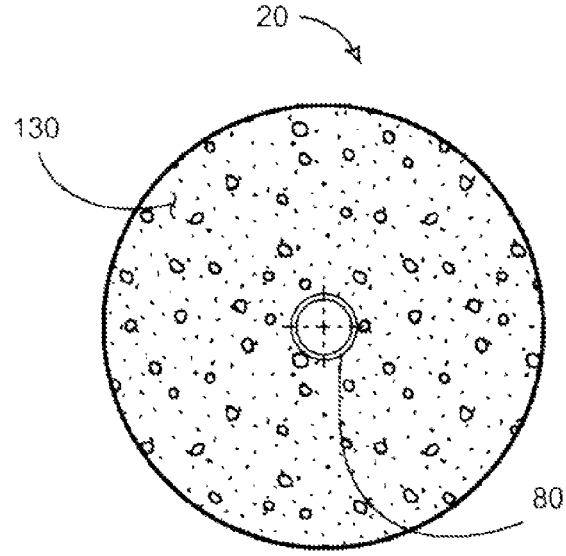
FIG. 3 is a top view of a standard installation with concrete surround
Figure 2:
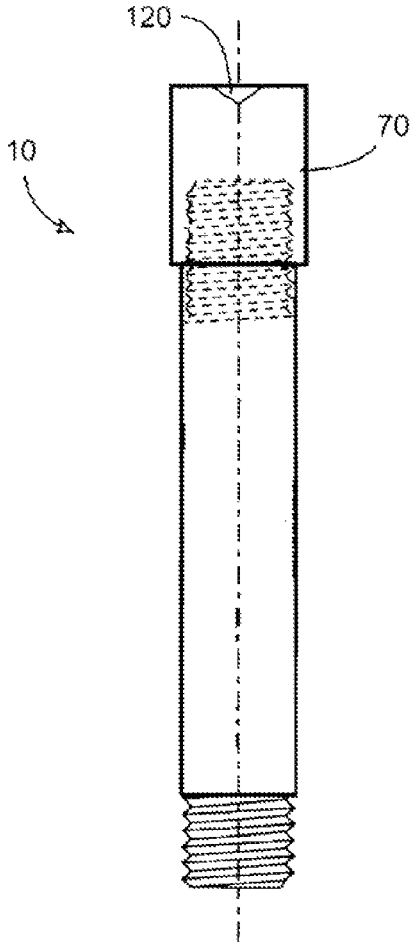
FIG. 2 is an elevation view of the standard base
Figure 4:
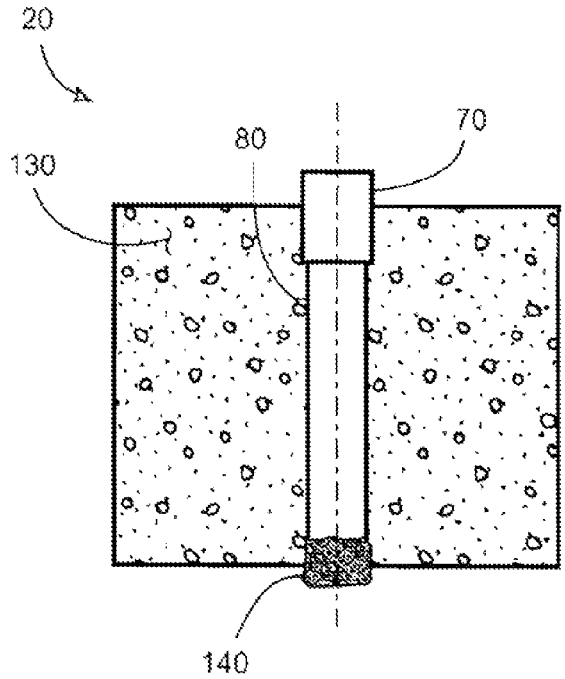
FIG. 4 is a cross sectional elevation view of the standard installation

The first base is for grass or soil that is packed tightly. Simply dig a hole roughly 10" in diameter by 8" deep, install the 1" by 8" galvanized nipple with a 1" galvanized coupling with the rest position keyway facing the primary at rest direction desired, i.e., towards the roadway. Install the 5,000 P.S.I. concrete mixture as shown in FIGS. 3 and 4. Put a stem fitting (described below) into the base nipple to make sure the base nipple is plumb during installation.

The second base 60 as shown in FIGS. 9 and 10 is for loose or sandy soil (beach installation). This base includes a 39" by 1" galvanized conduit nipple 80 with a 1" galvanized pipe coupling 70 with the keyway 120, again, facing the desired position for installation. Thread a 2" by 1" galvanized pipe nipple in to the keyway coupling to protect the keyway coupling from damage from the hammer used during installation. Using a small but adequate sledgehammer, drive the 39" length of pipe into the soft ground. Remove the 2" by 1" galvanized nipple after the base is hammered to a desired height. If the sandy soil is too loose, concrete can be used also like base shown in FIGS. 9 and 10.

There are three top stem pieces that are adaptable to all the most popular mailbox posts.

Figure 5:
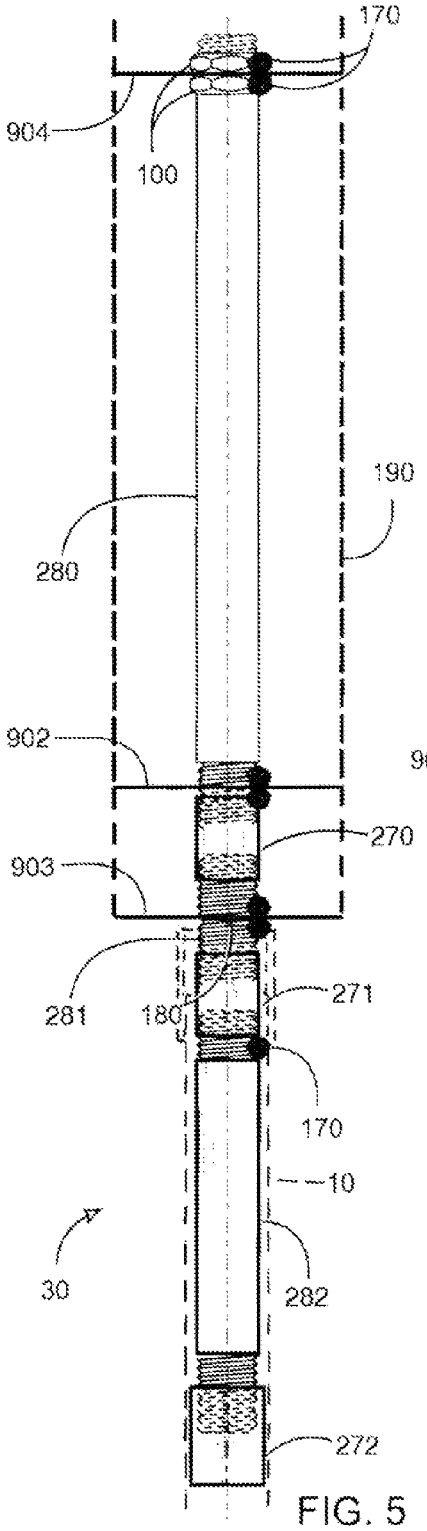
FIG. 5 is an elevation view of a standard post stem

The first is shown on FIG. 5 and is made to fit a standard 3½" PVC post. The stem has the top stem section and the bottom stem section. The top consists of two blankcovers 901 and 902 cut to fit inside the 3½" PVC post 190. One ½" galvanized lock nut 100 is threaded on each end of a 10" by ½" galvanized pipe nipple 280. Then the cut blankcovers 901 and 902 are installed. The top one 901 shown in FIG. 5 is secured by another ½" Gal. locknut 100. The mid-bottom cover 902 is held with a ½" gal. coupling 270. Next comes the very bottom cover 903 which is a 4" round blank cover (uncut). All of the blank covers 901, 902, 903 have a ½" knockout in the center. The P.V.C. post rests on the blank cover 903 which has a ½"#10 self tapping pan head (plated screw) 180 positioned to line up with the base 10 at rest position keyway 120. Then a 5"×½" gal. conduit pipe nipple 282 with a ½" gal. upper coupling 271 and with a ½" close nipple 272 on the top is threaded into the bottom ½" gal. coupling 281, from the top section, thereby securing the bottom plate 903 in between. The bottom section of the stem 30 is lowered into base 10 and freely rotates inside the 1" galvanized pipe base 10. The respective stem pieces are tack welded 170 together as shown in the drawing Figures (seven locations total) to assure continuity.

Figure 6:
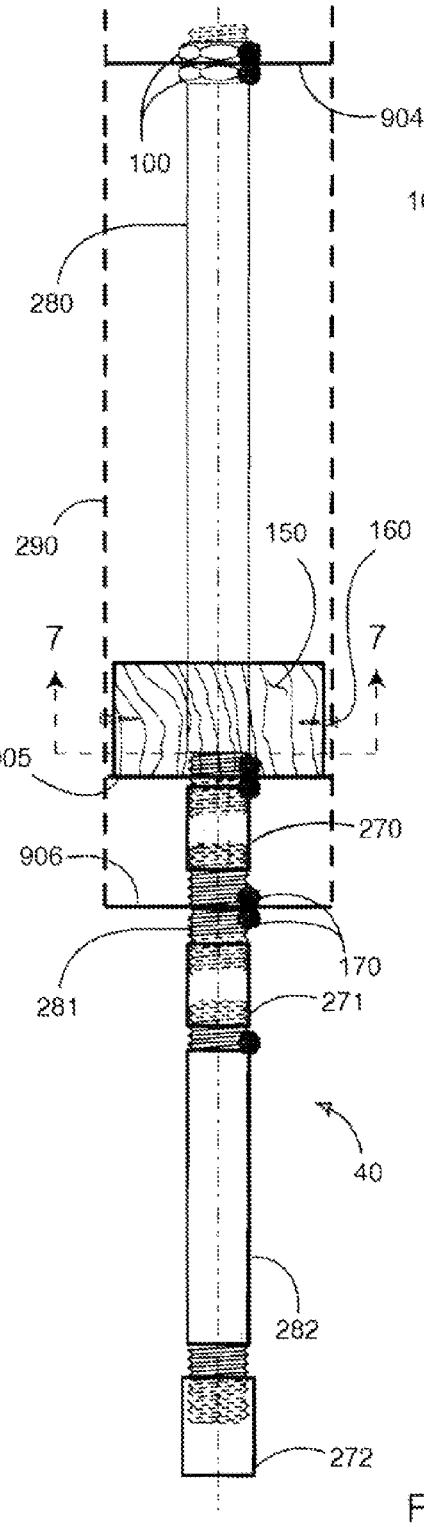
FIG. 6 is an elevation view of a post base for a 3" round steel post stem
Figure 7:
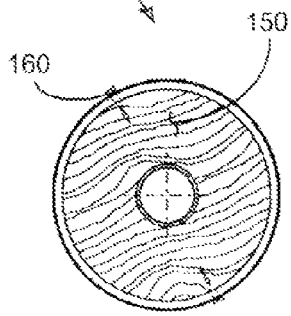
FIG. 7 is a cross sectional top view of the post base of FIG. 6 taken generally along lines 7-7 in FIG. 6

It is noted that all of the stem bottom piece connector pieces are all identical at the point where they extend from the ground and out of the surrounding base coupling 70. The top stem section 2 shown on FIG. 6 is designed for a 3" round steel post 290, which is made to be adaptable to many popular decorative skirts. A suitable post is manufactured by Architectural Mailbox, model #7505. The items necessary to secure the steel post include: Two round covers 904 and 905 with ⅞" knock outs in the center and cut to 2⅝" diameter to fit inside the 3" round steel post 290; one 2⅝" diameter×1½" pressure treated wood circle 150 with a ⅞" hole in the center. The bottom coupling 271 is secured to the typical bottom stem section. Then one 10"×½" pipe nipple 280 has a 2⅝" diameter pressure treated wood circle 150 slipped on, a ½" lock nut 100, one cut 2⅝" diameter cut blank 906 into the coupling which threads into the bottom section. On the top of the 10"×½" galvanized pipe nipple 280 is another cut 2⅝" inch diameter blank plate 904 secured by 2½" galvanized lock nuts. This is also tack welded 170 (as shown in FIG. 3). Lastly, two ⅛" holes are drilled in the 3" round steel post 290 for the two 1" galvanized deck screws 160 which secure the stem into the post.

Figure 8:
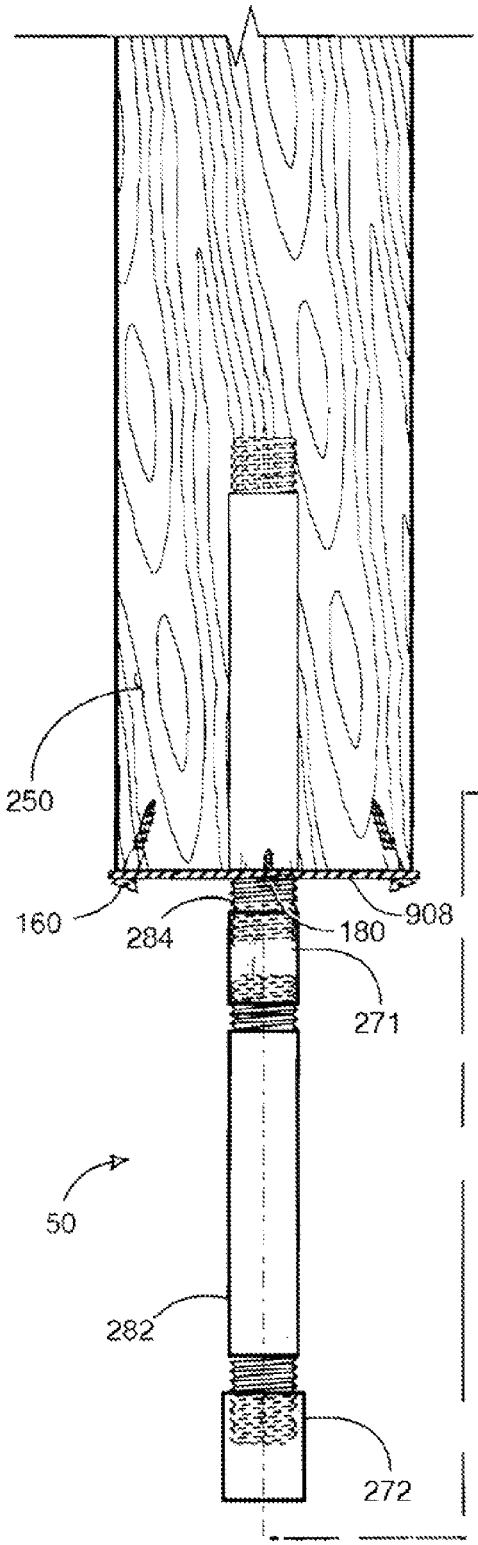
FIG. 8 is a partially sectioned elevation view of a stem for a typical 4×4 installation

With reference to FIG. 8, a the third type of stem post is a 3½"×3½" wood post 250, which is also adaptable to a US Fence 4×4 P.V.C. sleeve. First, a ⅞" hole is drilled in the center of the bottom end of the 3½"×3½" pressure treated wood post 250, commonly referred to as a 4×4. Next, the 5" galvanized pipe nipple 284 is threaded into the lower stem coupling. Next, a full size 4" round blank cover 908 with a ½" knockout is attached to the post 250 bottom by two #10×1½" galvanized deck screws 160 and a #10 galvanized washer. The bottom plate 908, which has the keyway screw 180 in the bottom thereof, has to line up the keyway screw with the base keyway 120 in base 10 to position the stem at rest.

The busy roadways of today definitely create a safety issue when you go to retrieve your mail. This easily constructed and assembled swing away post system allows a safe, easy way to access your mail. Simply swing the mailbox in a safe direction remote from traffic along the road edge, remove your mail and, then, swing it back to its normal, at rest, position for the next delivery.

The invention claimed is:

1. A swing away mailbox post, comprising:

a base part for in ground installation in the form of a first length of pipe nipple having a first diameter, with a coupling mounted on an upper end thereof, said coupling top surface edge including a beveled cut keyway notch that, upon installation, shall orient an at rest mailbox position in a predetermined direction, a lower end of said base encased in soil with said upper end including said coupling being set at approximately a finished grade of said soil; and, a stem part in the form of a complimentary second length of pipe nipple of smaller diameter than said base part first length and which fits within said first length, said second length being attached to a plate at an upper end thereof, said plate connecting to and supporting a mounted mailbox post, said plate further including a screw mounted to said plate and oriented so that a head thereof is downwardly directed and protrudes from an adjacent downwardly oriented surrounding surface of said plate, such that when said stem part is inserted into said base part, said stem freely swivels inside said base part, and said screw head engages in said beveled cut keyway to create an at rest position between said respective stem and base part.

2. A swing away mailbox post as in claim 1, wherein:

said first length comprises a 5 inch long 1 inch diameter galvanized pipe nipple.

3. A swing away mailbox post as in claim 2, wherein:

said second length comprises a 5 inch length of ½ inch diameter galvanized pipe nipple.

4. A swing away mailbox post as in claim 1, wherein:

said first length comprises a 40 inch long 1 inch diameter galvanized pipe nipple.

5. A swing away mailbox post as in claim 4, wherein:

said first length is set in concrete within said soil.

6. A swing away mailbox post as in claim 5, wherein:

said second length comprises a 5 inch length of ½ inch diameter galvanized pipe nipple.

7. A swing away mailbox post as in claim 1, wherein:

said mounted mailbox post is a 3 inch steel post.

8. A swing away mailbox post as in claim 1, wherein:

said mounted mailbox post is comprised of PVC.

9. A swing away mailbox post as in claim 1, wherein:

said mounted mailbox post is a 4×4 treated wood post.

* * * * *